US005083776A

United States Patent [19]

Liu

[11] Patent Number: 5,083,776

[45] Date of Patent: Jan. 28, 1992

[54] RACKET WITH ANTI-SHOCK AIR CUSHION

[76] Inventor: Jeffrey Liu, 4-1 Fl., No. 656, Sec. 4, Ba Teh Rd., Taipei, Taiwan

[21] Appl. No.: 665,658

[22] Filed: Mar. 7, 1991

[51] Int. Cl.[5] ..... A63B 49/00

[52] U.S. Cl. ..... 273/73 G; 273/73 R; 273/73 D

[58] Field of Search ..... 273/73 R, 73 C, 73 D, 273/73 G

[56] References Cited

U.S. PATENT DOCUMENTS 4,765,620 8/1988 James ..... 273/736

*Primary Examiner*—Edward M. Coven
*Assistant Examiner*—Raleigh W. Chiu
*Attorney, Agent, or Firm*—Zarley, McKee, Thomte, Voorhees & Sease

[57] ABSTRACT

A racket with anti-shock air cushions, constructed with poly-urethane air cushions provided at a lower end of the frame closely spaced with connecting tube passing therethrough. Inflation and exhaust elements are provided below the lower end of the frame and between two throats, thereby properly regulating the air cushions and attaining an optimal anti-shock effect.

3 Claims, 5 Drawing Sheets

RACKET WITH ANTI-SHOCK AIR CUSHION

BACKGROUND OF THE INVENTION

The present invention relates to a racket with anti-shock air cushions. The inflated air cushions clamp onto the ends of strings to absorb shock caused by hitting balls, thereby protecting players from injury.

The structure of conventional rackets can be distinguished from the present application. A conventional racket is characterized in having a elliptic frame, two throats provided below the frames, and a handle provided below the two throats.

Strings on the racket must possess certain tension so as to create a strong force to hit balls, wherein players' elbows endure comparable impact. Recently, rackets newly designed rackets have been improved by providing greater stiffness. This trend provides better swings and force to the ball, but at the the same time, increases reverse shock on the player' arms. Shock is the prime cause of tennis elbow and muscular pain. Therefore, rackets are provided with shock-absorbing means, such as a shock-absorbing rubber belt or a highly elastic handle cover, so as to decrease shock.

The shock-absorbing rubber belt having a belt body provided at a lower end of racket's face is incorporated among the strings of the racket face with two hooks of the belt body locking onto properly selected strings, thereby absorbing part of the shock caused by hitting balls right before the shock transfer to player's hands. However, the shock-absorbing ability of the rubber belt is not good enough. the rubber belt might also be hit by the balls and therefore influence the direction thereof.

It has been stressed that handles with "soft" characteristics can achieve the purpose of shock absorbing. However, players do not always hit the ball in the center of the racket. If players do not hit the ball in the center of the racket, a torque would be created toward the hand, therefore increasing burden on the players. Finally, players could hurt themselves and suffer from tennis elbow.

Furthermore, strings on the racket face will be inclined to move toward the outside periphery of the racket when the player swings the racket to hit the ball. The player has to reposition the strings, therefore causing inconvenience. Owing to the insufficiency of the anti-shock ability of conventional rackets, as well as of the rubber belt and reinforced handle, the inventor improves the racket to eliminate prior drawbacks by providing a racket with a set of anti-shock air cushions.

It is the purpose of this present invention, therefore, to mitigate and/or obviate the above-mentioned drawback in the manner set forth in the detailed description of the preferred embodiment.

SUMMARY OF THE INVENTION

Accordingly, it is an object of this invention to provide a racket with an anti-shock air cushion to decrease the shock transferred from the strings to the players' hand by encasing two ends of the strings with fully inflated air cushions.

A further object of this invention is to provide a racket taking advantage of inflation and exhaust means for conveniently replacing the strings.

Another object of this invention is to provide a set of air cushions to encase the lower end of the strings, therefore preventing the strings from moving when hit by the ball and saving the trouble of repositioning the strings.

Further objects and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
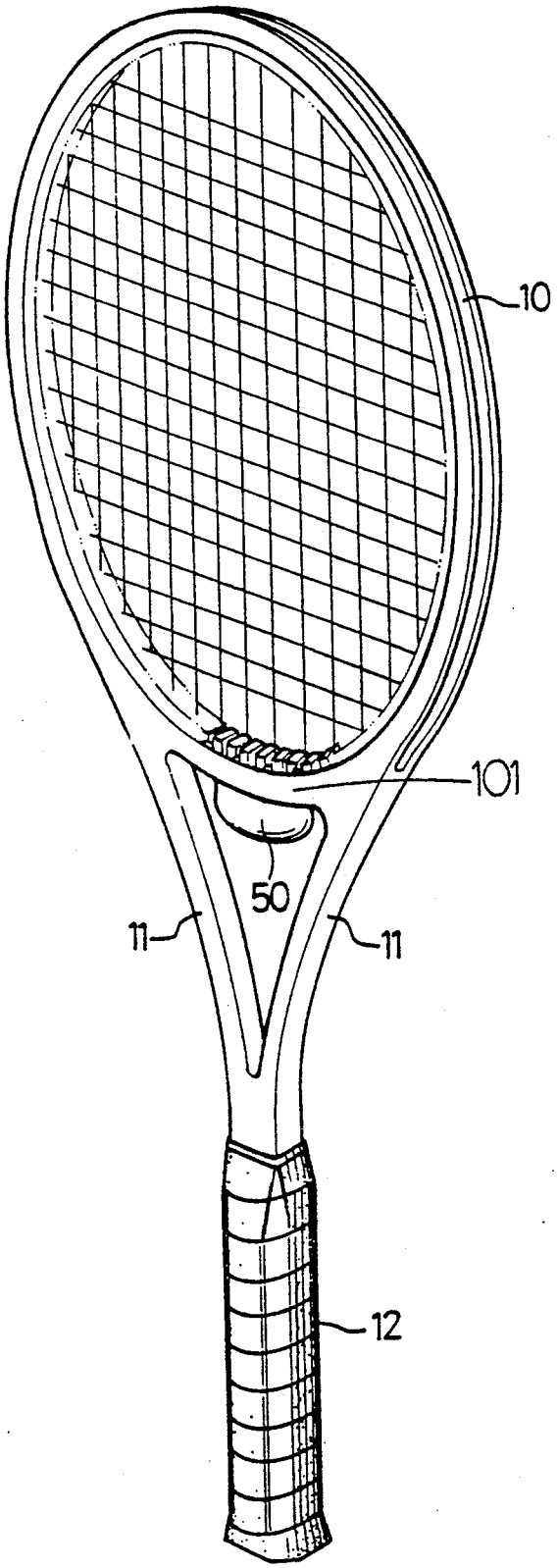
FIG. 1 is a perspective view of a racket with anti-shock air cushions in accordance with the present invention.
Figure 2:
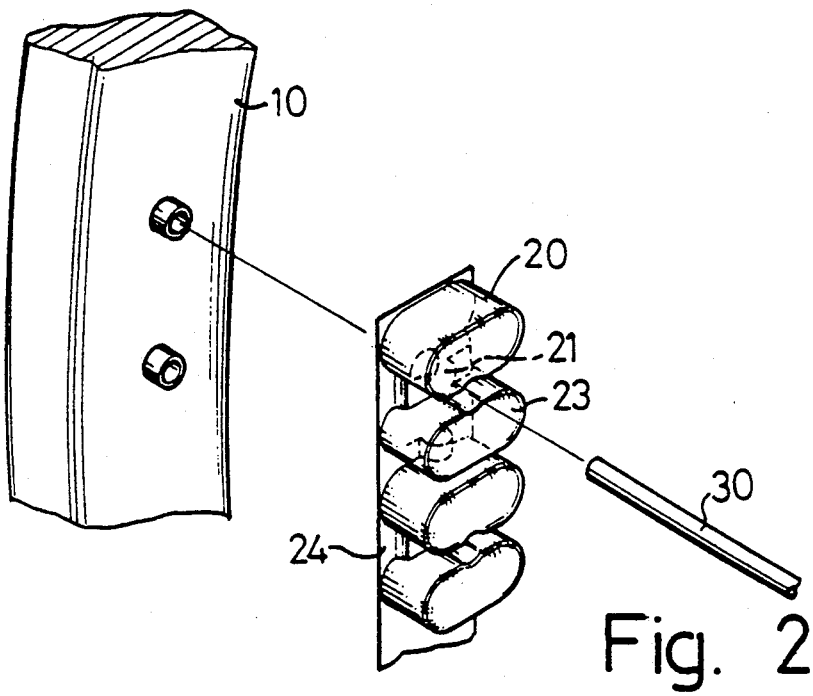
FIG. 2 is a partially exploded view thereof.

In reference to FIGS. 1 through 3, and 7, soft UP-made air cushions 20, provided at an inner periphery of a frame 10 of the racket, are closely lined up on a plate 24 having a connecting tube 22 to pass therethrough and conduct air therein. Between each pair of adjacent air cushions 20 above the plate 24 is a hole 21 for a string 30 to pass therethrough and attach to the frame 10.

Figure 5:
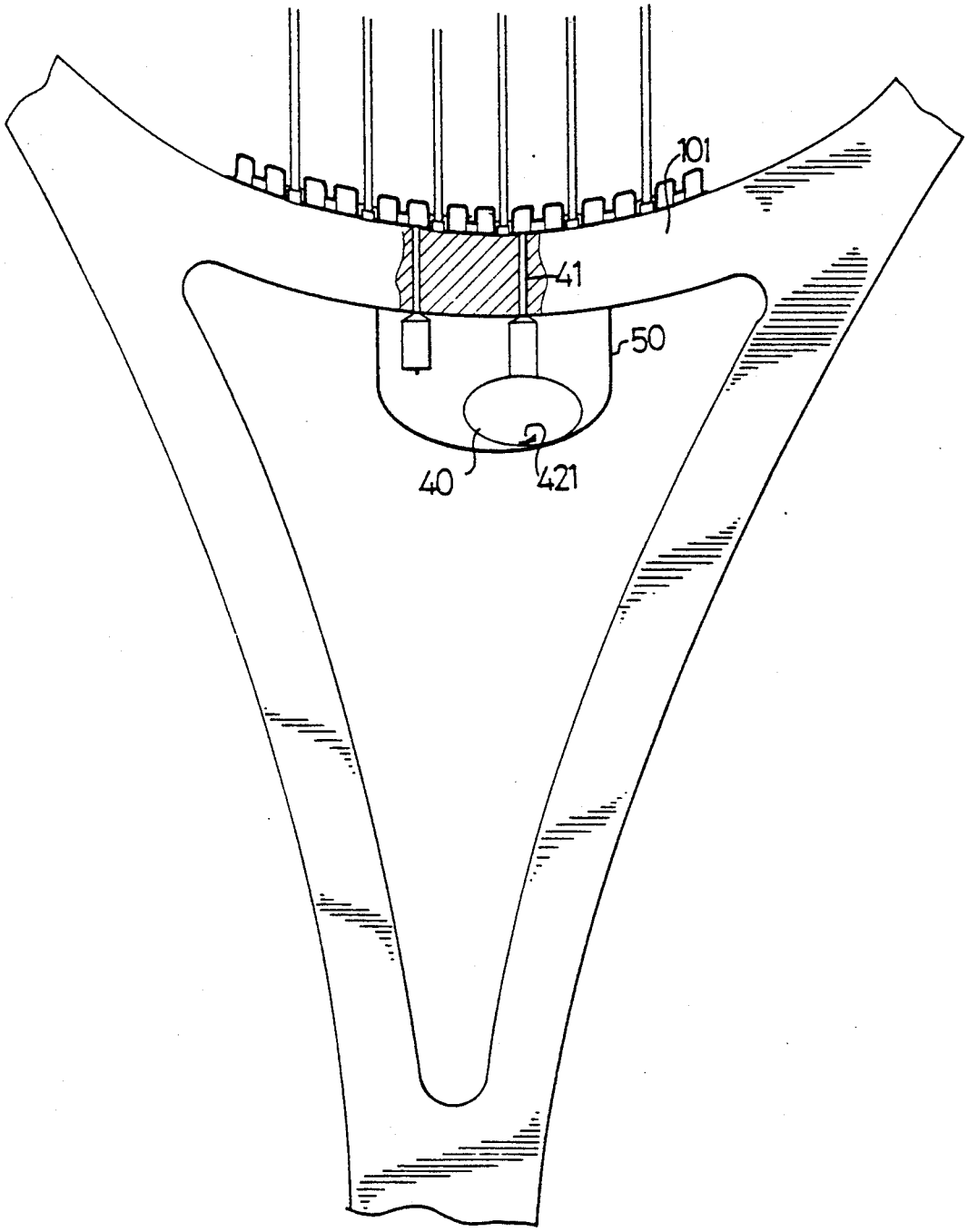
FIG. 5 is a schematic view of the inflation means thereof.
Figure 6:
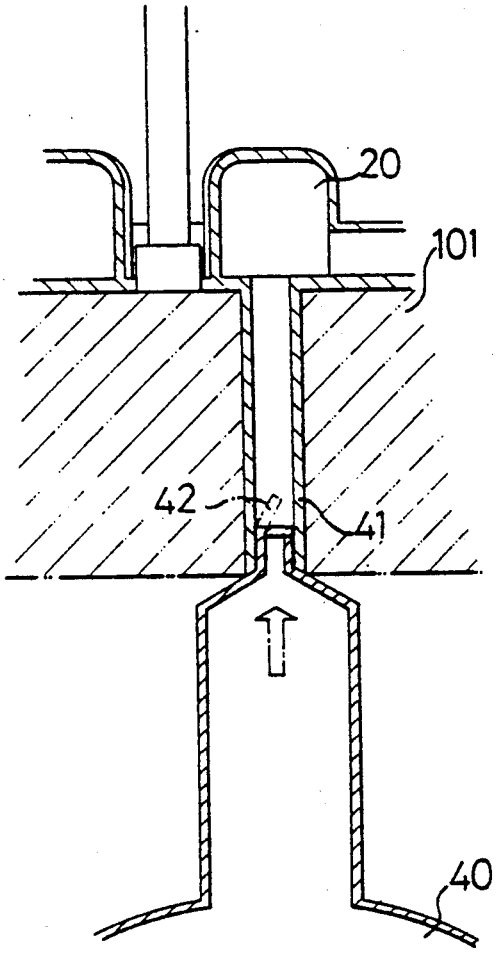
FIG. 6 is a schematic view of the inflation means thereof on an enlarged scale.
Figure 7:
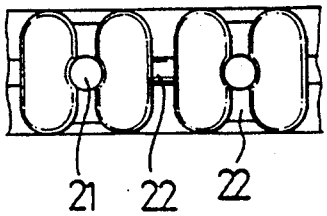
FIG. 7 is a plan view of air cushions thereof.

In reference to FIGS. 1, 5 and 6, a space between an open throat defined by two throats 11 and a yoke 101 is provided with inflation and exhaust means. The inflation means comprises a air capsule 40, an inflation tube 41, first check valve 42, and second check valve 421. The inflation tube 41 passes through the yoke 101, thereby providing a conduit from the air capsule 40 to the air cushion 20. The first check valve 42 provided at a lower end of the inflation tube 41 will open to allow air to be pumped into the air cushion 20 and will close to prevent the air from leaking. In a lower end of the air capsule 40 is provided a second check valve 421 to allow air from outside the air capsule 40 to enter therein and to keeep air inside air capsule 40 from leaking. Below the yoke 101 is provided an air mask 50 to contain the inflation tube 41, air capsule 40, second check valve 421, and the exhaust means, which is characterized in protecting the air capsule 40 from damage caused by collision.

Figure 8:
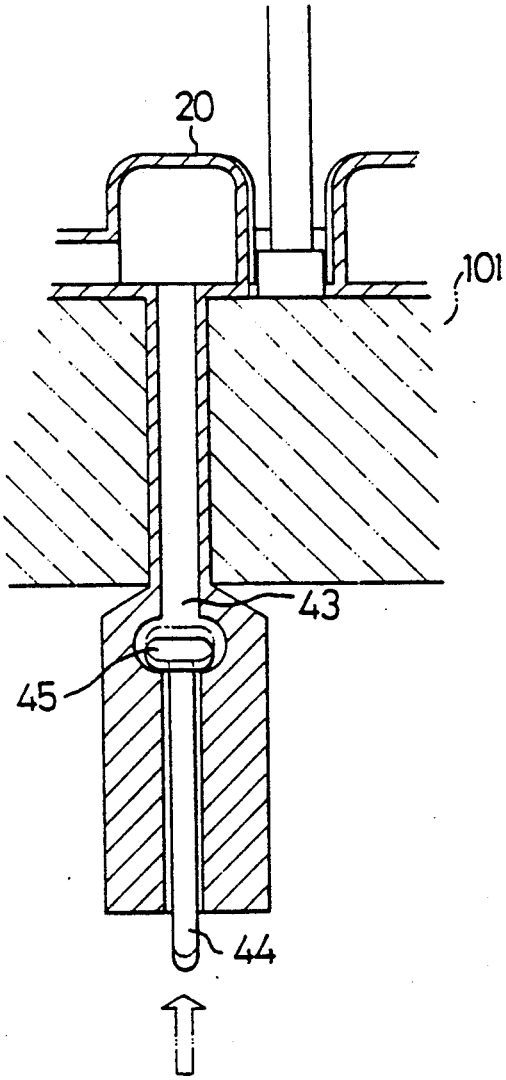
FIG. 8 is a schematic view of exhaust means of this invention.

In reference to FIG. 8, the exhaust means comprises a exhaust tube 43, plug 44, and a block 45. The exhaust tube 43 passes through the yoke 101 and connects with an air cushion 20. The plug 44 is provided in the exhaust tube 43 with a lower end thereof protruding out of the exhaust tube 43. The block 45 is provided on an upper end of the plug 44 to plug an inlet of the exhaust tube 43. After removing the air mask 50, one can press the air capsule 40 to pump air through the inflation tube 41 into an air cushion 20 and sequentially into other air cushions through the connecting tube 22. When the inflation is completed, the air capsule 40 gradually inflates, resulting from the air coming through the second check valve 421 into the air capsule 40 therein; therefore, the air capsule 410 is ready for another inflation cycle. With respect to exhaust means, the block 45 is provided at the upper end of the plug 44 to plug the inlet of the exhaust tube 43 and prevent leaking. Pushing the plug 44 upward will remove the block 45 and exhaust the air.

Figure 3:
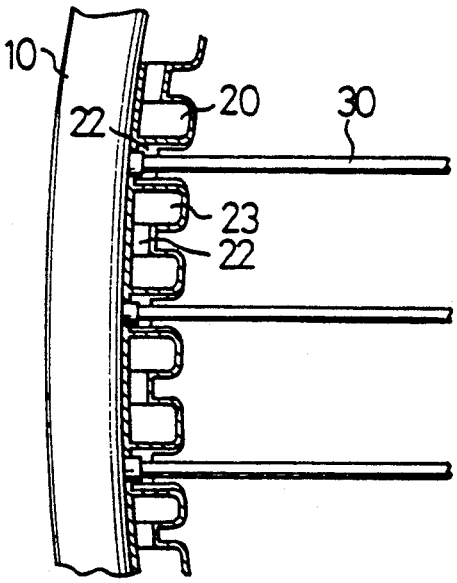
FIG. 3 is a partial cross-sectional view thereof.
Figure 4:
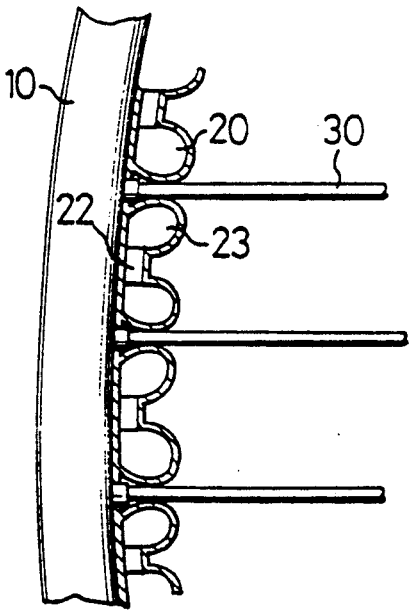
FIG. 4 is a partial schematic view of the air cushions after inflation.

In reference to the air cushions of FIGS. 3 and 4, the cushion wall near the string side is thicker than the cushion wall on the other side; therefore, fully-inflated air cushions 20 and 23 will clamp string 30 tightly. Consequently, the mechanism will decrease shock and also prevent the string 30 from moving. Furthermore, one can replace string 30 conveniently after deflation.

Accordingly, the present invention provides a racket with anti-shock air cushions provided on an inner periphery of a frame 10, resulting in less shock and therefore preventing players' elbows from serious damage. Consequently, the present invention is a racket with highly efficient and elastic shock-absorbing qualities.

While the present invention has been explained in relation to its preferred embodiment, it is to be understood that various modififcations thereof will be apparent to those skilled in the art upon reading this specification. Therefore, it is to be understood that the invention disclosed herein is intended to cover all such modification as shall fall within the scope of the appended claims.

I claim:

1. A racket with anti-shock air cushions including a frame having string holes therethrough, a handle, and an open throat defined by two throats, said frame including a yoke between said two throats, the improvement comprising:

an annular plate being provided on an inner periphery of said frame, a plurality of air cushions being provided on an inner periphery of said annual plate, each having a communicating tube passing therethrough for communicating each two adjacent said air cushions, said air cushions being closely lined up on said annular plate for providing a shock-absorbing effect after inflation, a hole being provided between each two adjacent said air cushions for a string to pass therethrough to be anchored to said frame, and an inflation an exhaust means provided in said open throat below said yoke to control the inflation.

2. A racket with anti-shock air cushions according to claim 1, wherein the inflation means comprises:

an air capsule having an inflation tube connected thereon, said inflation tube having a first check valve at an upper end thereof passing through said yoke and connecting to one of said air cushions and a second check valve provided at a lower end of said air capsule to allow air therein:

an exhaust means comprising an exhaust tube, a plug, and a block, said exhaust tube passes through said yoke and connects to one of said air cushions, a lower end of said plug protrudes from said exhaust tube and an upper end thereof is provided with said block to block the inlet of said exhaust tube, so that air can be pushed through said inflation tube into said air cushions by pressing said air capsule; air can be drawn into said air capsule through second check valve when said air capsule is released to attain an inflation cycle with said block plugging said inlet of said exhaust tube to avoid leaking; and air can be exhausted by pressing a lower end of said plug upward.

3. A racket with anti-shock air cushions according to claim 2, wherein a mask is provided to mask said air capsule and protect said air capsule from damage caused by collision.

* * * * *